US007957661B2

(12) United States Patent
Cao et al.

(10) Patent No.: US 7,957,661 B2
(45) Date of Patent: Jun. 7, 2011

(54) CONTROL OF OVERHEATING IN AN IMAGE FIXING ASSEMBLY

(75) Inventors: Jichang Cao, Lexington, KY (US); William Paul Cook, Lexington, KY (US); John William Kietzman, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 156 days.

(21) Appl. No.: 12/494,418

(22) Filed: Jun. 30, 2009

(65) Prior Publication Data

US 2010/0329705 A1 Dec. 30, 2010

(51) Int. Cl.
*G03G 15/20* (2006.01)

(52) U.S. Cl. ..... 399/69; 399/33; 399/122

(58) Field of Classification Search ..... 399/33, 399/69, 122, 320, 325, 327, 328, 329
See application file for complete search history.

(56) References Cited

U.S. PATENT DOCUMENTS 5,669,039 A 9/1997 Ohtsuka
6,185,389 B1 2/2001 Bartley
6,304,731 B1 10/2001 Able

*Primary Examiner* — David P Porta
*Assistant Examiner* — Mark R Gaworecki

(57) ABSTRACT

An image fixing assembly includes a heating unit having a heating element and a fusing member enclosing the heating element; a backup member; and a heat conducting member. The fusing member is configured to rotate around the heating element. Further, the fusing member is capable of being heated by the heating element. The backup member is abuttingly coupled to the fusing member for configuring a nip portion therebetween, and is capable of pressing media sheets against the fusing member, when the media sheets pass through the nip portion. The heat conducting member is capable of retractably coupling to one of the fusing member and the backup member for enabling flow of heat between the one of the fusing member and the backup member, and the heat conducting member, for reducing a thermal gradient. Further disclosed is a method for fixing images on the media sheets using the image fixing assembly.

20 Claims, 4 Drawing Sheets

CONTROL OF OVERHEATING IN AN IMAGE FIXING ASSEMBLY

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to an image fixing assembly of an image forming apparatus, and more specifically, to controlling overheating in an image fixing assembly of an image forming apparatus in order to enhance throughput of the image forming apparatus while printing media sheets.

2. Description of the Related Art

In an image forming apparatus, such as an electrophotographic printing apparatus, unfused toner images (i.e., latent images) are fixed on a media sheet by an image fixing assembly of the image forming apparatus. Typically, an image fixing assembly of an image forming apparatus includes a heating unit having a heating element and a fusing member, and a backup member abuttingly coupled to the fusing member of the heating unit. Further, the fusing member of the heating unit may be in the form of either a fuser roll or a fuser belt. Furthermore, the heating element of the heating unit may be in the form of either a lamp or a ceramic heater. An image fixing assembly having a fuser roll enclosing a lamp may be referred to as "hot roll fuser system" and an image fixing assembly having a fuser belt enclosing a ceramic heater may be referred to as "belt fuser system".

As described above, the backup member of the image fixing assembly is abuttingly coupled to the fusing member for configuring a nip portion therebetween. The media sheet carrying the unfused toner images thereon passes through the nip portion in order to allow fixing of the unfused toner images. Specifically, when the media sheet carrying the unfused toner images passes through the nip portion, the heating element provides heat to the media sheet and the backup member applies pressure onto the media sheet to enable fixing of the unfused toner images onto the media sheet.

In an instance when a narrow media sheet, such as an envelope, passes through the nip portion, the narrow media sheet does not extend across the full width of the fusing member and the backup member. Accordingly, thermal energy accumulates at portions of the fuser member and the backup member that are not in contact with the narrow media sheet. Specifically, the portions of the fusing member and the backup member that are not covered by the narrow media sheet tend to accumulate more heat as opposed to portions of the fusing member and the backup member that are covered by the narrow media sheet. As a result, a thermal gradient is generated on the fusing member and the backup member of the image fixing assembly. Further, there is a gradual increase in the thermal gradient in such an image fixing assembly after printing several consecutive narrow media sheets. Accordingly, high temperatures at the portions of the fusing member and the backup member where a narrow media sheet is not present may cause damage to the image fixing assembly and components thereof.

In addition, a hot roll fuser system employed as the image fixing assembly in an image forming apparatus is associated with a high thermal mass. Specifically, the hot roll fuser system includes a fuser roll as the fusing member and a backup roll as the backup member, and both the fuser roll and the backup roll are, in general, manufactured from thick metal cores that are surrounded by rubber layers. Accordingly, the hot roll fuser system is associated with a large thermal mass due to the use of the thick metal cores that are surrounded by the rubber coating for manufacturing the fuser roll and the backup roll. A thermal gradient generated in such a hot roll fuser system is related to the thermal mass of the hot roll fuser system, and the respective thicknesses of the metal cores and the rubber coating of the fuser roll and the backup roll. Further, in a typical hot roll fuser system, the thermal gradient is generated slowly after printing several consecutive narrow media sheets. However, fixing of a first image during printing of media sheets using the hot roll fuser system, which employs the fuser roll having the large thermal mass, becomes time-consuming, as there may exist a delay in raising the temperature of the fuser roll prior to printing. Specifically, the large thermal mass of the hot roll fuser system leads to a long warm-up time for printing a first media sheet.

Further, printing narrow media sheets may gradually lead to failure of the hot roll fuser system. In such an instance, an inter-page gap may be increased to allow excess heat to dissipate from the fuser roll and the backup roll, and to allow the excess heat to conduct to portions having a lower temperature, particularly, the portions of the fuser roll and the backup roll covered by the narrow media sheets. Typically, the inter-page gap is increased after a first count of narrow media sheets, and may again be increased one or more times after subsequent counts of narrow media sheets. As a result, throughput associated with the printing of the narrow media sheets is reduced as opposed to throughput associated with printing of full width media sheets. The term, "inter-page gap," relates to the separation between successive media sheets.

Alternatively, a belt fuser system, which employs a fuser belt as the fusing member, is associated with a thermal mass lower than that of the hot roll fuser system. Specifically, the belt fuser system employs an amount of metal for manufacturing the fuser belt that is lower than the amount of metal required for manufacturing the fuser roll of the hot roll fuser system. Accordingly, the belt fuser system is associated with a lower thermal mass. Further, the lower amount of metal in the belt fuser system results in a lower axial thermal conductivity as opposed to the hot roll fuser system. Furthermore, the lower thermal mass leads to a short warm-up time for printing a first media sheet as opposed to the printing of the first media sheet using the hot roll fuser system. However, the lower axial thermal conductivity of the fusing member of the belt fuser system poses difficulty while printing narrow media sheets. Specifically, a high thermal gradient is generated after successive printing of narrow media sheets due to the lower axial thermal conductivity, which may lead to a failure of the belt fuser system. Accordingly, the inter-page gap may be increased in the belt fuser system to allow excess heat to dissipate from the fusing member and the backup member, and to allow the excess heat to conduct to portions having lower temperature, particularly, the portions of the fusing member and the backup member covered by the narrow media sheets. Consequently, generation of a high thermal gradient may severely impact throughput of the belt fuser system. Specifically, throughput for printing the narrow media sheets may be reduced by a factor of 10 as opposed to throughput for printing full width media sheets. More specifically, by increasing the inter-page gap, throughput associated with the belt fuser system is reduced in order to avoid damage to the belt fuser system by overheating of various components thereof.

Moreover, a delay before printing full width media sheets may be required after printing several narrow media sheets using either the hot roll fuser system or the belt fuser system. Additionally, generation of the thermal gradient, particularly, generation of a high temperature on portions of the fusing member and the backup member may cause a defect in print quality, as unfused toner tends to stick to the heating unit instead of properly adhering to a media sheet. This problem may be prominent in the belt fuser system, since the belt fuser system requires a longer time period for recovering from a state with a high thermal gradient, due to less conduction of heat between the portions not covered by media sheets and the portions covered by the media sheets.

Various techniques have been developed in order to reduce a thermal gradient generated in an image fixing assembly for controlling overheating in the image fixing assembly. One such conventional technique to reduce the thermal gradient generated on a fusing member enclosing a heating element, and a backup member of an image fixing assembly includes turning off the heating element when a narrow media sheet exits the nip portion between the fusing member and the backup member. Specifically, the heating element is turned off to allow the fusing member and the backup member to dissipate heat from portions thereof that are not in contact with the media sheet, thereby reducing the thermal gradient generated in the image fixing assembly. Accordingly, printing of full width media sheets after printing of narrow media sheets using such a technique proves to be time-consuming due to the delay required for turning off of the heating element for reducing the thermal gradient and then turning the heating element on for maintaining a requisite temperature prior to subsequent rounds of printing full width media sheets after printing narrow media sheets.

Another conventional technique to control overheating in an image fixing assembly employs a use of a temperature sensing member, such as a thermistor. The temperature sensing member may be operatively coupled to one of a fusing member and a backup member of the image fixing assembly to detect a thermal gradient generated thereon. Specifically, the temperature sensing member may be coupled to the backup member for sensing the temperature of the backup member. Further, the temperature sensing member may be coupled to a controller, which is further coupled to a heating element of a heating unit of the image fixing assembly. The controller controls the operation of the heating element based on the temperature of the backup member. Further, the controller maintains the heating element at or near a target temperature when the temperature of the backup member is within a predefined temperature range. For example, when the temperature sensing member detects a high temperature on a portion of the backup member not covered by a narrow media sheet, the controller may either modify (i.e., reduce) the target temperature of the heating element or may deactivate the heating element. Alternatively, the controller may control the operation of the heating element based on the temperature of the backup member during fusing of at least one initial narrow media sheet and during fusing of at least one subsequent narrow media sheet. Accordingly, inter-page gap may be increased in order to control the thermal gradient for controlling overheating in the image fixing assembly. Additionally, when the thermal gradient is reduced to a pre-determined value, a full width media sheet may be printed by the image fixing assembly.

Alternatively, in absence of the temperature sensing member, the inter-page gap may be increased after printing of a pre-determined number of narrow media sheets. Further, in the absence of the temperature sensing member, a pre-determined time delay may be introduced before continuing printing of narrow media sheets. Accordingly, an increase in the inter-page gap and/or introduction of the pre-determined time delay results in reduction of throughput for printing narrow media sheets and full width media sheets by the image fixing assembly.

Accordingly, there is a need for controlling overheating in an image fixing assembly of an image forming apparatus in order to enhance throughput of the image forming apparatus while printing narrow media sheets and full width media sheets.

SUMMARY OF THE DISCLOSURE

In view of the foregoing disadvantages inherent in the prior art, the general purpose of the present disclosure is to control overheating in an image fixing assembly, to include all the advantages of the prior art, and to overcome the drawbacks inherent therein.

In one aspect, the present disclosure provides an image fixing assembly for an image forming apparatus. The image fixing assembly comprises a heating unit, a backup member, and a heat conducting member. The heating unit comprises a heating element, and a fusing member that encloses the heating element. Further, the fusing member is configured to rotate around the heating element, and is capable of being heated by the heating element. The backup member is abuttingly coupled to the fusing member for configuring a nip portion therebetween. Furthermore, the backup member is capable of pressing media sheets against the fusing member when the media sheets pass through the nip portion. The heat conducting member is capable of retractably coupling to one of the fusing member and the backup member for configuring a thermal conduction path therebetween for enabling flow of heat between the one of the fusing member and the backup member, and the heat conducting member, for reducing a thermal gradient on at least one of the fusing member and the backup member. The reduction of the thermal gradient on the at least one of the fusing member and the backup member allows for the reduction of an inter-page gap between the media sheets passing through the nip portion, thereby enhancing throughput of the image forming apparatus.

In another aspect, the present disclosure provides a method for fixing images on media sheets. The method comprises providing the media sheets to an image fixing assembly. The image fixing assembly comprises a heating unit, a backup member, and a heat conducting member. The heating unit comprises a heating element, and a fusing member enclosing the heating element. The fusing member is configured to rotate around the heating element, and is capable of being heated by the heating element. The backup member is abuttingly coupled to the fusing member for configuring a nip portion therebetween. Further, the backup member is capable of pressing the media sheets against the fusing member when the media sheets pass through the nip portion. The heat conducting member is capable of retractably coupling to one of the fusing member and the backup member for configuring a thermal conduction path therebetween for enabling flow of heat between the one of the fusing member and the backup member, and the heat conducting member.

The method further comprises detecting a thermal gradient on at least one of the fusing member and the backup member, when the media sheets pass through the nip portion. Furthermore, the method comprises coupling the heat conducting member to the one of the fusing member and the backup member on detection of the thermal gradient on the at least one of the fusing member and the backup member, wherein the coupling of the heat conducting member with the one of the fusing member and the backup member enables flow of heat between the heat conducting member and the one of the fusing member and the backup member, for reducing the thermal gradient on the at least one of the fusing member and the backup member. Additionally, the method comprises decoupling the heat conducting member from the one of the fusing member and the backup member on reduction of the thermal gradient on the at least one of the fusing member and the backup member.

BRIEF DESCRIPTION OF THE DRAWINGS

The above-mentioned and other features and advantages of this disclosure, and the manner of attaining them, will become more apparent and the disclosure will be better understood by reference to the following description of embodiments of the disclosure taken in conjunction with the accompanying drawings, wherein.

DETAILED DESCRIPTION

Figure 1:
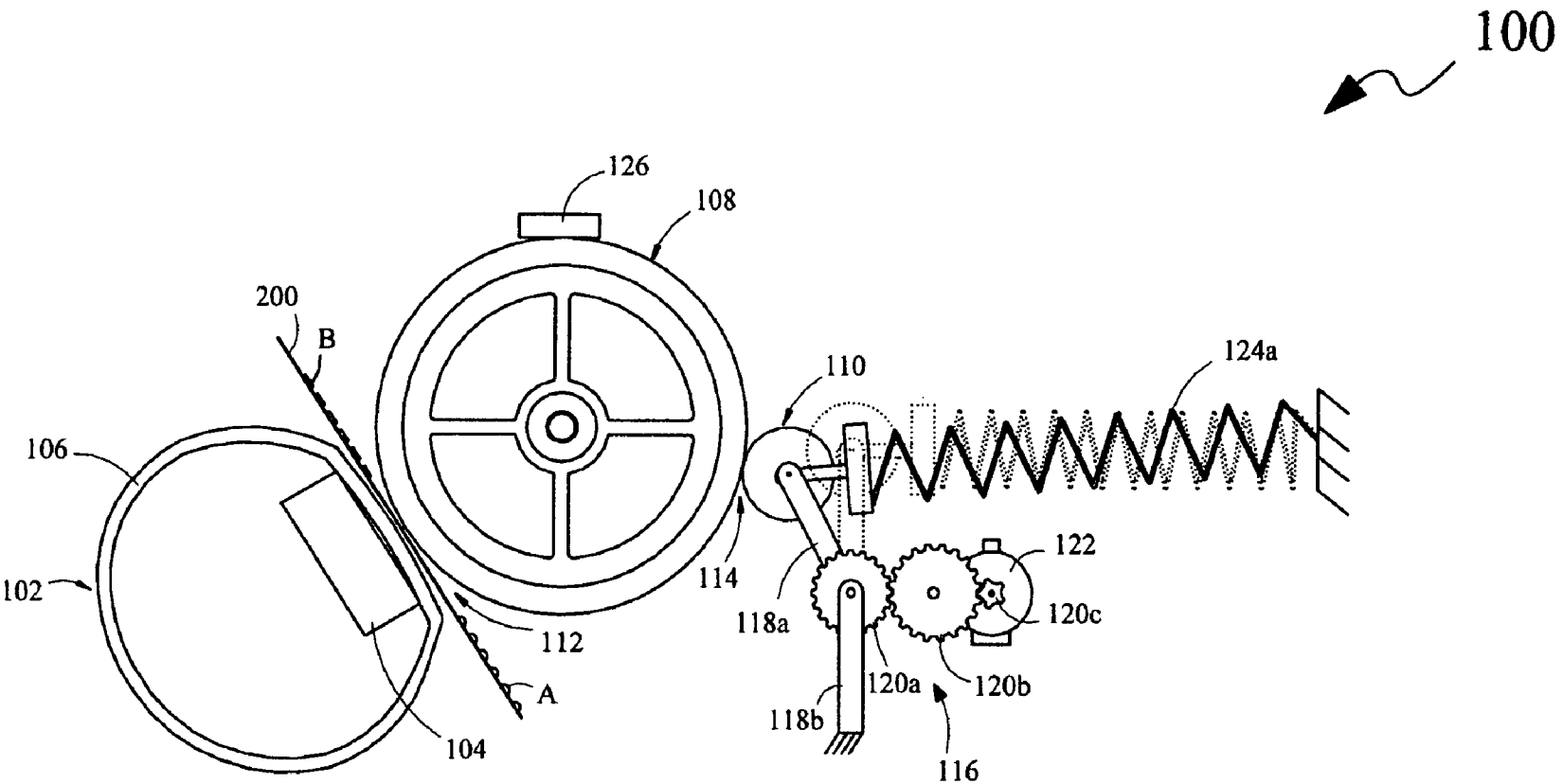
FIG. 1 is a schematic depiction of an image fixing assembly of an image forming apparatus, according to an exemplary embodiment of the present disclosure.

It is to be understood that various omissions and substitutions of equivalents are contemplated as circumstances may suggest or render expedient, but these are intended to cover the application or implementation without departing from the spirit or scope of the claims of the present disclosure. It is to be understood that the present disclosure is not limited in its application to the details of components set forth in the following description. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item. Unless limited otherwise, the term "coupled," and variations thereof herein is used broadly and encompasses direct and indirect couplings. Furthermore, the use of "coupled" and variations thereof herein does not denote a limitation to the arrangement of two components.

In addition, as used herein, the term "abuttingly coupled" refers to a coupling between two components placed adjacent to each other such that each component is capable of transmitting its motion to the other component.

The present disclosure provides an image fixing assembly that may be employed in an image forming apparatus, such as an electrographic printer or copier. The image fixing assembly of the present disclosure is capable of controlling overheating of various components thereof by reducing the thermal gradient generated therein, in order to enhance throughput of the image forming apparatus, while printing narrow media sheets and full width media sheets.

The image fixing assembly of the present disclosure includes a heating unit, a backup member, and a heat conducting member. The heating unit includes a heating element, and a fusing member that encloses the heating element. Further, the fusing member is configured to rotate around the heating element, and is capable of being heated by the heating element. The backup member is abuttingly coupled to the fusing member for configuring a nip portion therebetween. Furthermore, the backup member is capable of pressing media sheets against the fusing member when the media sheets pass through the nip portion. The heat conducting member is capable of retractably coupling to one of the fusing member and the backup member for configuring a thermal conduction path therebetween for enabling flow of heat between the one of the fusing member and the backup member, and the heat conducting member, for reducing a thermal gradient generated on at least one of the fusing member and the backup member. The reduction of the thermal gradient generated on the at least one of the fusing member and the backup member allows for the reduction of an inter-page gap between the media sheets passing through the nip portion, thereby enhancing throughput of the image forming apparatus as compared to conventional image forming apparatuses. The image fixing assembly of the present disclosure is explained in detail in conjunction with FIGS. 1-3.

Figure 2:
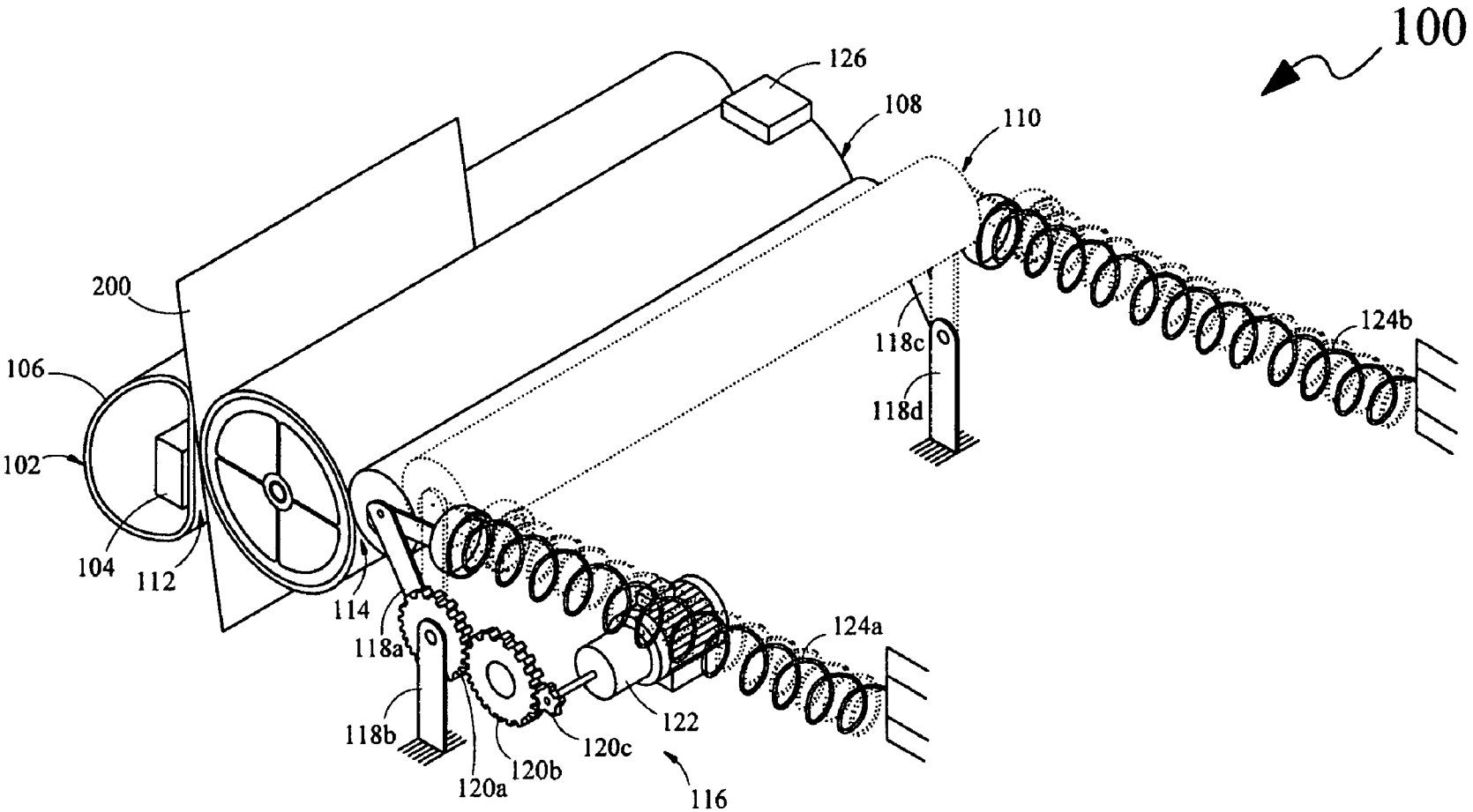
FIG. 2 is a perspective view of the image fixing assembly of FIG. 1, according to an exemplary embodiment of the present disclosure.

Referring to FIGS. 1 and 2, an image fixing assembly 100 to be employed in an image forming apparatus (not shown) is depicted, according to an exemplary embodiment of the present disclosure. Specifically, FIG. 1 is a schematic depiction of image fixing assembly 100 and FIG. 2 is perspective view of image fixing assembly 100. As shown in FIGS. 1 and 2, image fixing assembly 100 includes a heating unit 102 having a heating element 104 and a fusing member 106. Image fixing assembly 100 further includes a backup member 108 abuttingly coupled to fusing member 106 of heating unit 102, and a heat conducting member 110 capable of being retractably coupled to backup member 108.

In the present embodiment, as depicted in FIGS. 1 and 2, image fixing assembly 100 is a "belt fuser system." Specifically, in image fixing assembly 100 (belt fuser system), heating element 104 is a ceramic heater and fusing member 106 is a fuser belt. Further, backup member 108 may have an elongated cylindrical configuration (as shown in FIG. 2). However, it will be evident to those skilled in the art that the image fixing assembly 100 may be "a hot roll fuser system", which is further explained in detail in conjunction with FIG. 3, according to another embodiment of the present disclosure.

As depicted in FIGS. 1 and 2, fusing member 106 encloses heating element 104, and is capable of being heated by heating element 104. Specifically, heating element 104 is configured to contact an inner portion (not numbered) of fusing member 106 for heating fusing member 106. Further, fusing member 106 is configured to rotate around heating element 104. It will be evident to those skilled in the art that fusing member 106 may be rotated by rotation of backup member 108.

Further, as explained herein above, backup member 108 is abuttingly coupled to fusing member 106 of heating unit 102. More specifically, backup member 108 is abuttingly coupled to fusing member 106 for configuring a nip portion 112 therebetween. Nip portion 112 is capable of receiving narrow media sheets and full width media sheets. Specifically, nip portion 112 is capable of receiving a narrow media sheet, such as a media sheet 200. Suitable examples of media sheet 200 include, but are not limited to, an envelope, an A5 media sheet, a 32 pounds (lb) executive media sheet, and a 90 lb cardstock media sheet, which may be cut to a narrow width. For the purpose of the description and as shown in FIG. 2, media sheet 200 is aligned/positioned at a reference edge (not numbered) with regard to fusing member 106 and backup member 108 within the imaging forming apparatus. However, it will be evident to those skilled in the art that media sheet 200 may be aligned/positioned at a central portion (not numbered) within the imaging forming apparatus. Specifically, the image forming apparatus may be a center-fed media feed system, where media sheet 200 may be aligned/positioned centrally along respective lengths of fusing member 106 and backup member 108.

Further, backup member 108 is capable of pressing media sheet 200 against fusing member 106, when media sheet 200 passes through nip portion 112. Media sheet 200 carries unfused toner images (as depicted by symbol 'A') thereon prior to passing through nip portion 112. Once media sheet 200 passes through nip portion 112, the unfused toner images are fused and fixed onto media sheet 200 to form fused toner images (as depicted by symbol 'B') thereon. More specifically, heat is provided by heating element 104 through fusing member 106 onto media sheet 200, and pressure is applied by backup member 108, which is abuttingly coupled to fusing member 106, onto media sheet 200 for fusing and fixing of the unfused toner images to form fused toner images onto media sheet 200. The term 'passing' of media sheet 200 through nip portion 112 may refer to entry of media sheet 200 into nip portion 112 for printing, movement of media sheet 200 through nip portion 112 while printing, and exit of media sheet 200 from nip portion 112 post printing.

In an instance, when narrow media sheets, such as media sheet 200, pass through nip portion 112, a thermal gradient may be generated on at least one of fusing member 106 and backup member 108. For example, as shown in FIG. 2, when media sheet 200 passes through nip portion 112, a thermal gradient is generated onto portions (not numbered) of backup member 108; and heating unit 102, and specifically, fusing member 106 of heating unit 102, which are not in contact with media sheet 200. Media sheet 200 does not extend across the full width of fusing member 106 and backup member 108. Accordingly, a portion (not numbered) of each of fusing member 106 and backup member 108 is covered by media sheet 200, and a portion of each of fusing member 106 and backup member 108 remains uncovered. The portions of fusing member 106 and backup member 108 that are not covered by media sheet 200 tend to retain more heat (thermal energy) as opposed to portions of fusing member 106 and backup member 108 that are covered by media sheet 200. Such a non-uniform distribution of heat over fusing member 106 and backup member 108 generates a thermal gradient on fusing member 106 and backup member 108. It should be understood that the generation of the thermal gradient on the at least one of fusing member 106 and backup member 108 refers to generation of the thermal gradient on surfaces (not numbered) of the at least one of fusing member 106 and backup member 108.

The term, "thermal gradient," as used herein refers to temperature differences at the portions of fusing member 106 and backup member 108 that are not covered by media sheet 200 and the portions of fusing member 106 and backup member 108 that are covered by media sheet 200. For example, a portion (not numbered) of backup member 108 not covered by media sheet 200 is exposed to fusing member 106 and such an exposure causes rise in temperature of the portion of backup member 108 as opposed to a portion (not numbered) of backup member 108 covered by media sheet 200. Further, when several consecutive narrow media sheets, such as media sheet 200, pass through nip portion 112, a thermal gradient may be generated on the at least one of fusing member 106 and backup member 108.

In the present disclosure, heat conducting member 110 is capable of reducing the thermal gradient from the at least one of fusing member 106 and backup member 108. Specifically, heat conducting member 110 helps in minimizing temperature inequality on the at least one of fusing member 106 and backup member 108. For example, as explained herein in conjunction with FIGS. 1 and 2, heat conducting member 110 is retractably coupled to backup member 108. Accordingly, when heat conducting member 110 is retractably coupled to backup member 108, a thermal conduction path 114 is configured therebetween for enabling flow of heat between backup member 108 and heat conducting member 110, in order to reduce the thermal gradient generated on the at least one of fusing member 106 and backup member 108. The term, "thermal conduction path," as used herein refers to a path for heat conduction and is defined along an axial line contact configured between backup member 108 and heat conducting member 110, when heat conducting member 110 couples to backup member 108. Specifically, heat conducting member 110 is configured to assume a position shown with solid lines for depicting coupling of heat conducting member 110 with backup member 108, and a position shown with dotted lines for depicting decoupling of heat conducting member 110 from backup member 108.

As shown in FIGS. 1 and 2, in the present embodiment, heat conducting member 110 is a roll. Specifically, heat conducting member 110 is configured to assume an elongated cylindrical configuration. Further, it will be evident to those skilled in the art that heat conducting member 110 may be either a solid core roll or a hollow core roll. For example, heat conducting member 110 may either be a hollow core elongated cylindrical structure, such as a pipe; or a solid core elongated cylindrical structure. Accordingly, when heat conducting member 110 couples to backup member 108 that also has an elongated cylindrical configuration, the axial line contact defining thermal conduction path 114 is configured therebetween.

The retractable coupling of heat conducting member 110 with backup member 108 is enabled by a retracting mechanism 116, as shown in FIGS. 1 and 2. Retracting mechanism 116 includes connecting members, such as connecting members 118*a*, 118*b*, 118*c*, and 118*d*; a gear assembly having a plurality of gears, such as gears 120*a*, 120*b*, and 120*c*; a motor 122; and a pair of compression springs 124*a* and 124*b*. Connecting members 118*a* and 118*c* are coupled at lateral end portions (not numbered) of heat conducting member 110. Specifically, upper end portions (not numbered) of connecting members 118*a* and 118*c*, are rigidly coupled to lateral end portions (not numbered) of heat conducting member 110.

Further, the connecting members, such as connecting members 118*a* and 118*c*, are pivotally coupled to connecting members 118*b* and 118*d*, respectively. More specifically, a lower end portion (not numbered) of connecting member

118*a* is coupled to an upper end portion (not numbered) of connecting member 118*b* with the help of gear 120*a* positioned therebetween. In the present embodiment, gear 120*a* is rigidly coupled to the lower end portion of connecting member 118*a* and rotatably coupled to the upper end portion of connecting member 118*b*, thereby enabling a pivotal coupling of connecting member 118*a* with connecting member 118*b*. Accordingly, rotation of gear 120*a* in a specific direction allows for retractable coupling of heat conducting member 110 to backup member 108. Further, a lower end portion of connecting member 118*c* is pivotally coupled to an upper end portion of connecting member 118*d*. Furthermore, lower end portions of connecting members 118*b* and 118*d* may be rigidly coupled to suitable portions of the image forming apparatus for supporting heat conducting member 110 therewithin. Moreover, upper end portions of connecting members 118*a* and 118*c* are also rigidly coupled to compression springs 124*a* and 124*b*, respectively. Compression springs 124*a* and 124*b* may further be coupled to portions of the image forming apparatus for suitably supporting heat conducting member 110 within the image forming apparatus.

As described above, heat conducting member 110 is pivotally moved by the gear assembly, motor 122, and compression springs 124*a* and 124*b* in order to establish retractable coupling of heat conducting member 110 with backup member 108. Specifically, energy stored in compression springs 124*a* and 124*b* tends to push heat conducting member 110 for being coupled to backup member 108. More specifically, heat conducting member 110, as shown with solid lines in FIG. 2, is shown to be coupled to backup member 108 with the help of compression springs 124*a* and 124*b*. Further, when heat conducting member 110 is coupled to backup member 108, motor 122 is not energized. Accordingly, when motor 122 is energized, heat conducting member 110 pivotally moves away from backup member 108 for decoupling. More specifically, as shown in FIGS. 1 and 2, gear 120*a* is meshed with gear 120*b*, which is further meshed with gear 120*c*. Further, gear 120*c* is coupled to a shaft (not numbered) of motor 122 for being rotated by motor 122. Accordingly, the shaft of motor 122 rotates gear 120*c*, which further rotates gear 120*b* for rotating gear 120*a*, when motor 122 is energized. Rotation of gear 120*a* pivotally moves connecting members 118*a* and 118*c* away from backup member 108 by compressing compression springs 124*a* and 124*b*, for decoupling heat conducting member 110 from backup member 108. Decoupling of heat conducting member 110 from backup member 108 is shown with the help of dotted lines in FIG. 2.

However, it will be evident to a person skilled in the art that the retractable coupling of heat conducting member 110 to backup member 108 may be enabled by any other retracting mechanism known in the art. Specifically, such retracting mechanism may include a solenoid operatively coupled to heat conducting member 110 for providing a pivotal movement (to and fro) to heat conducting member 110. Alternatively, the retracting mechanism may simply include a motor (such as a stepper motor) and a gear assembly without any compression spring for providing the pivotal movement to heat conducting member 110.

In the present embodiment, heat conducting member 110 is adapted to retractably couple to backup member 108 on generation of the thermal gradient on the at least one of fusing member 106 and backup member 108. More specifically, as shown in FIGS. 1 and 2, heat conducting member 110 is adapted to couple to backup member 108 on detection of the thermal gradient generated on the at least one of fusing member 106 and backup member 108.

In addition, heat conducting member 110 may be adapted to retractably couple to backup member 108 on detection of narrow media sheets, such as media sheet 200, passing through nip portion 112 prior to generation of the thermal gradient on the at least one of fusing member 106 and backup member 108. More specifically, image fixing assembly 100 may include a sensor (not shown) capable of detecting narrow media sheets that are about to pass through nip portion 112. Accordingly, heat conducting member 110 may retractably couple to backup member 108 prior to generation of the thermal gradient on the at least one of fusing member 106 and backup member 108, in order to prevent any delay in printing operation.

In an instance where narrow media sheets are printed continuously, heat conducting member 110 may be adapted to retractably couple to backup member 108 in order to reduce the thermal gradient for allowing a higher throughput while printing the narrow media sheets. However, after passage of a stream of narrow media sheets or prior to passage of one or more full width media sheets through nip portion 112, the reduced thermal gradient may still be unacceptable for subsequent printing due to print quality problems. Although the thermal gradient is reduced to avoid overheating of image fixing assembly 100 and components thereof, the thermal gradient may need to be further reduced in order to achieve uniform heating across the full width of fusing member 106. Accordingly, a delay after the passage of the stream of narrow media sheets or prior to the passage of the one or more full width media sheets through nip portion 112 may be required, to allow the thermal gradient to be further reduced prior to resuming printing. Such a delay may be introduced with the help of a motor that continues to rotate fusing member 106 while preventing or reducing the supply of power to heating element 104, until the thermal gradient is reduced to a point where print quality is acceptable across the full width of fusing member 106. Further, such delay is lower than the delay which occurs in the absence of heat conducting member 110. Heat conducting member 110 may be retracted from backup member 108 subsequent to reducing the thermal gradient to an acceptable value.

As described above, heat conducting member 110 may remain in the retractably coupled positioned with backup member 108 after passage of the narrow media sheets through nip portion 112, and prior to the passage of the one or more full width media sheets through nip portion 112.

In one embodiment of the present disclosure, the thermal gradient generated on the at least one of fusing member 106 and backup member 108 may be detected by a temperature sensing member. For example, image fixing assembly 100 may include at least one temperature sensing member operatively coupled to the one of fusing member 106 and backup member 108 for detecting the thermal gradient on the at least one of fusing member 106 and backup member 108. In the present embodiment, a temperature sensing member 126 is operatively coupled to backup member 108 for detecting the thermal gradient on backup member 108. More specifically, the detection of the thermal gradient on backup member 108 may be performed by determining a temperature difference of backup member 108. The temperature difference of backup member 108 may be determined as a difference between the temperature of backup member 108 when full width media sheets pass through nip portion 112, and the temperature of backup member 108 when one or more narrow media sheets pass through nip portion 112.

Specifically, temperature sensing member 126 may be coupled to backup member 108 for sensing the temperature of backup member 108. Further, the temperature sensing member may be coupled to a controller (not shown), which may further coupled to heating element 104 of heating unit 102 of image fixing assembly 100. The controller controls the operation of heating element 104 based on the temperature of backup member 108. Further, the controller maintains heating element 102 at or near a target temperature when the temperature of backup member 108 is within a predefined temperature range. The controller may include a system memory, one or more processors and/or other logic requisite to control functions of image fixing assembly 100.

Alternatively, image fixing assembly 100 may be operatively coupled to a counting unit for counting a predetermined number of narrow media sheets that pass through nip portion 112, for the detection of the thermal gradient on the at least one of fusing member 106 and backup member 108. More specifically, the predetermined number of narrow media sheets passing through nip portion 112 may be associated with the generation of the thermal gradient on the at least one of fusing member 106 and backup member 108. For example, a thermal gradient may be generated on the at least one of fusing member 106 and backup member 108, when 15 narrow media sheets pass through nip portion 112.

In the present embodiment, the detection of the thermal gradient on backup member 108 enables heat conducting member 110 to couple with backup member 108. As explained herein above in conjunction with the present embodiment, when heat conducting member 110 is retractably coupled to backup member 108, thermal conduction path 114 is configured therebetween. The configuration of thermal conduction path 114 between backup member 108 and heat conducting member 110 enables flow of heat between backup member 108 and heat conducting member 110.

More specifically, when the thermal gradient is detected on backup member 108, heat conducting member 110 is coupled to backup member 108 allowing heat to flow from backup member 108 to heat conducting member 110 along thermal conduction path 114. Accordingly, an end portion (not numbered) of heat conducting member 110, where media sheet 200 is not present, heats up faster, which generates a thermal gradient on heat conducting member 110. Further, the end portion of heat conducting member 110 having high temperature transfers heat to a portion of heat conducting member 110 having a lower temperature. However, backup member 108 continues to provide heat to the entire heat conducting member 110. Accordingly, the portion of heat conducting member 110 having the lower temperature eventually reaches a temperature equivalent to the temperature of backup member 108.

As a result, heat transfer from the portion of backup member 108 having a lower temperature to heat conducting member 110 is averted. However, heat conducting member 110 is continuously heated by backup member 108 where media sheet 200 is not present, and accordingly, heat conducting member 110 continues to transfer heat from the portion thereof having the higher temperature to the portion thereof having the lower temperature. Consequently, heat conducting member 110 acquires a higher temperature as compared to backup member 108 on the portion where media sheet 200 is present. In such an instance, backup member 108 is heated by heat conducting member 110, causing flow of heat between backup member 108 and heat conducting member 110 for the reduction of the thermal gradient in backup member 108.

In addition, heat conducting member 110 helps in reducing the thermal gradient from backup member 108 by radiating heat to surrounding air. Specifically, the portion of heat conducting member 110 having a higher temperature radiates more heat as compared to the portion of heat conducting member 110 having a lower temperature.

When the thermal gradient on backup member 108 is reduced, there is a rise in temperature of the portion of backup member 108 that is in contact with media sheet 200, while there is a relative decrease in temperature of the portion of backup member 108 that is not in contact with media sheet 200. Due to such temperature variation, exchange of heat from the portion of fusing member 106 that is in contact with media sheet 200 to backup member 108 decreases, and exchange of heat from the portion of fusing member 106 that is not in contact with media sheet 200 to backup member 108 increases. As a result, the thermal gradient associated with fusing member 106 decreases.

Heat conducting member 110 employed in image fixing assembly 100 is composed of a thermally conductive material, which is capable of exchanging heat with the at least one of fusing member 106 and backup member 108 in order to reduce the thermal gradient generated on the at least one of fusing member 106 and backup member 108. Suitable examples of the thermally conductive material for manufacturing heat conducting member 110 include, but are not limited to, aluminum, copper, steel, and combinations thereof.

In the present embodiment, once the thermal gradient generated on at least one of fusing member 106 and backup member 108 is reduced, heat conducting member 110 may subsequently be decoupled and moved away from backup member 108 to configure the position depicted by the dotted lines in FIG. 2. Specifically, temperature sensing member 126 detects the reduction in the thermal gradient on the at least one of fusing member 106 and backup member 108. Subsequently, an electrical signal may be sent to electrical circuitry of the image forming apparatus for energizing motor 122, in order to decouple heat conducting member 110 from backup member 108.

Further, even after reduction of the thermal gradient generated while printing narrow media sheets, the thermal gradient may be regenerated on the at least one of fusing member 106 and backup member 108 when subsequent narrow media sheets and full width media sheets exit nip portion 112 in a continuous printing process. Accordingly, heat conducting member 110 may again be retractably coupled to backup member 108 for reducing the regenerated thermal gradient from the at least one of fusing member 106 and backup member 108.

The reduction of the thermal gradient from the at least one of fusing member 106 and backup member 108 enables an enhanced throughput of the image forming apparatus employing image fixing assembly 100. Specifically, the reduction of the thermal gradient from the at least one of fusing member 106 and backup member 108 enables a reduced inter-page gap, which is typically provided between subsequent narrow media sheets, passing through nip portion 112. The term "inter-page gap," as used herein is defined in terms of separation between successive media sheets passing through nip portion 112 for being printed. In other words, the "inter-page gap" relates to a pause in between printing the successive media sheets in the image forming apparatus.

Table 1 illustrates test results for printing two types of narrow media sheets using image fixing assembly 100 having heat conducting member 110 that is decoupled from backup member 108, and using image fixing assembly 100 having heat conducting member 110 that is coupled to backup member 108. Specifically, table 1 shows test results, depicting temperatures of various components, such as heating element 104, fusing member 106, and backup member 108, of image fixing assembly 100 when heat conducting member 110 is coupled to backup member 108 and when heat conducting member 110 is decoupled from backup member 108. Further, the temperatures of the various components, as depicted in table 1 are associated with temperatures of portions of the various components where a narrow media sheet, such as media sheet 200, is not present.

Furthermore, table 1 shows test results for image fixing assembly 100 with the following test setup conditions. Heating element 104 was set at a fixed temperature measured at an end portion of heating element 104 that was in contact with a narrow media sheet. A temperature sensing member, similar to temperature sensing member 126, was used to detect the temperature of heating element 104. Further, fusing member 106 was set to rotate at a fixed speed of about 7.58 inches per second (ips). Furthermore, the inter-page gap for narrow media sheets was set to a fixed value of about 2 inches in order to result in a fixed throughput, which is equal to the highest throughput of about 35 media sheets per minute. Moreover, the test was terminated when temperature of backup member 108 was about to reach a value (such as 200 degrees Celsius (° C.)) that would have otherwise damaged image fixing assembly 100. However, it should be apparent that such a test may also be terminated when backup member 108 attains a stable maximum temperature (safe operating temperature).

Moreover, test results as depicted in table 1 relate to a number of media sheets printed with image fixing assembly 100. Specifically, an intermediate count of media sheets was noted at an intermediate temperature for fusing member 106 of image fixing assembly 100 to indicate the rate at which the thermal gradient was generated, when heat conducting member 110 was coupled to backup member 108 and when heat conducting member 110 was decoupled from backup member 108. For example, a higher number of media sheets indicates that the thermal gradient increased more slowly.

TABLE 1

| Coupling/Decoupling of Heat Conducting Member 110 | Image Fixing Assembly 100 with Heat Conducting Member 110 Decoupled from Backup Member 108 | | Image Fixing Assembly 100 with Heat Conducting Member 110 Coupled to Backup member 108 | |
|---|---|---|---|---|
| Media Sheet | 32 lb Executive Media Sheet | 90 lb (4.25" × 11") Cardstock Media Sheet | 32 lb Executive Media Sheet | 90 lb (4.25" × 11") Cardstock Media Sheet |
| Total Number of Media Sheets Printed | 60 | 30 | 200 | 100 |
| Total Number of Media Sheets Printed when Temperature of Fusing Member 106 was 230° C. | 18 | 8 | >200 | 35 |
| Highest Temperature of Heating Element 104 (° C.) | 291 | 317 | 260 | 305 |
| Highest Temperature of Fusing Member 106 (° C.) | 246 | 285 | 216 | 255 |
| Highest Temperature of Backup Member 108 (° C.) | 193 | 207 | 138 | 161 |

As shown in table 1, a total number of 32 lb executive media sheets printed was 60, when heat conducting member 110 was decoupled from backup member 108. Further, the intermediate count of 32 lb executive media sheets was 18 at the intermediate temperature of fusing member 106. Furthermore, fusing member 106 never reached the intermediate temperature when 32 lb executive media sheets were printed while heat conducting member 110 was coupled to backup member 108. The test for printing the 32 lb executive media sheets, when heat conducting member 110 was coupled to backup member 108, was stopped after 200 of such 32 lb executive media sheets were printed. Accordingly, it was observed that the use of heat conducting member 110 increases throughput of the image forming apparatus when employed for printing 32 lb executive media sheets.

Similarly, a total number of 90 lb cardstock media sheets printed was 30, when heat conducting member 110 was decoupled from backup member 108. Further, the intermediate count of 90 lb cardstock media sheets was 8 at the intermediate temperature of fusing member 106. Alternatively, fusing member 106 reached the intermediate temperature when 35 of such 90 lb cardstock media sheets were printed in while heat conducting member 110 was coupled to backup member 108. Moreover, fusing member 106 never crossed the temperature limit of 200° C. while printing of 90 lb cardstock media sheets when heat conducting member 110 was coupled to backup member 108. The test was stopped after 100 of such 32 lb executive media sheets were printed.

As shown in table 1, it may be observed that the highest temperature detected on heating element 104 while printing a 32 lb executive media sheet was about 291° C., when heat conducting member 110 was decoupled from backup member 108. As opposed, the highest temperature detected on heating element 104 while printing a 32 lb executive media sheet was about 260° C., when heat conducting member 110 was coupled to backup member 108. Similarly, it may be observed that the highest temperature detected on heating element 104 while printing a 90 lb cardstock media sheet was about 317° C., when heat conducting member 110 was decoupled from backup member 108. In contrast, the highest temperature detected on heating element 104 while printing a 90 lb cardstock media sheet was about 305° C., when heat conducting member 110 was coupled to backup member 108.

In addition, it may be observed that the highest temperature detected on fusing member 106 on portions thereof that were not covered with a 32 lb executive media sheet was about 246° C., when heat conducting member 110 was decoupled from backup member 108. In comparison, the highest temperature detected on fusing member 106 on portions thereof that were not covered with a 32 lb executive media sheet was about 216° C., when heat conducting member 110 was coupled to backup member 108. Accordingly, the thermal gradient associated with fusing member 106 was reduced while printing 32 lb executive media sheets, when heat conducting member 110 was coupled to backup member 108. Similarly, it may be observed that the highest temperature detected on fusing member 106 on portions thereof that were not covered with a 90 lb cardstock media sheet was about 285° C., when heat conducting member 110 was decoupled from backup member 108. In contrast, the highest temperature detected on fusing member 106 on portions that were not covered with a 90 lb cardstock media sheet was about 255° C., when heat conducting member 110 was coupled to backup member 108. Accordingly, the thermal gradient associated with fusing member 106 was also reduced while printing 90 lb cardstock media sheets, when heat conducting member 110 was coupled to backup member 108.

Moreover, it may be observed that the highest temperature detected on backup member 108 on portions thereof that were not covered with a 32 lb executive media sheet was about 193° C., when heat conducting member 110 was decoupled from backup member 108. In comparison, the highest temperature detected on backup member 108 on portions thereof that were not covered with a 32 lb executive media sheet was about 138° C., when heat conducting member 110 was coupled to backup member 108. Accordingly, the thermal gradient associated with backup member 108 was reduced while printing 32 lb executive media sheets, when heat conducting member 110 was coupled to backup member 108. Similarly, it may be observed that the highest temperature detected on backup member 108 on portions thereof that were not covered with a 90 lb cardstock media sheet was about 207° C., when heat conducting member 110 was decoupled from backup member 108. In contrast, the highest temperature detected on backup member 108, on portions thereof that were not covered with a 90 lb cardstock media sheet was about 161° C., when heat conducting member 110 was coupled to backup member 108. Accordingly, the thermal gradient associated with backup member 108 was also reduced while printing 90 lb cardstock media sheets, when heat conducting member 110 was coupled to backup member 108.

Table 1 signifies that heat conducting member 110 enables a reduced thermal gradient associated with the various components, such as fusing member 106, and backup member 108, of image fixing assembly 100, which provides an easy handling of narrow media sheets being printed with the image forming apparatus. Further, it will be evident that reasonable sizes and weights of narrow media sheets, i.e., 32 lb executive media sheet, may be printed continuously without increasing an inter-page gap. Additionally, printing of narrow long heavy media sheets, i.e., 90 lb (4.25"×11") cardstock media sheet may be slowed down by adding an inter-page gap, however, throughput of the image forming apparatus is greatly increased when heat conducting member 110 is employed as opposed to throughput of an image forming apparatus without heat conducting member 110.

As described above in conjunction with FIGS. 1 and 2, image fixing assembly 100 is a belt fuser system, having fusing member 106 to be the fuser belt, which is associated with low thermal mass.

Further, in the belt fuser system, heating element 104 has low axial thermal conductivity. Accordingly, the amount of heat accumulated in the belt fuser system is high during printing of narrow media sheets. As a result, a large thermal gradient is generated on the at least one of fusing member 106 and backup member 108 of the belt fuser system. Accordingly, the handling of the belt fuser system due to the generation of the large thermal gradient on fusing member 106 and backup member 108 becomes more difficult, when narrow media sheets are being printed by the belt fuser system. Therefore, employing a heat conducting member, such as heat conducting member 110, in the belt fuser system, helps in reducing the large thermal gradient while substantially increasing the throughput of the image forming apparatus.

In an alternative embodiment, image fixing assembly 100 may be a hot roll fuser system, having fusing member 106 to be a fuser roll. Accordingly, by employing a heat conducting member, such as heat conducting member 110, in the hot roll fuser system, throughput of the image forming apparatus, employed with the hot roll fuser system, may also be enhanced. Use of heat conducting member 110 in the hot roll fuser system having a fusing member in the form of a fuser roll, is explained in detail in conjunction with FIG. 3.

Figure 3:
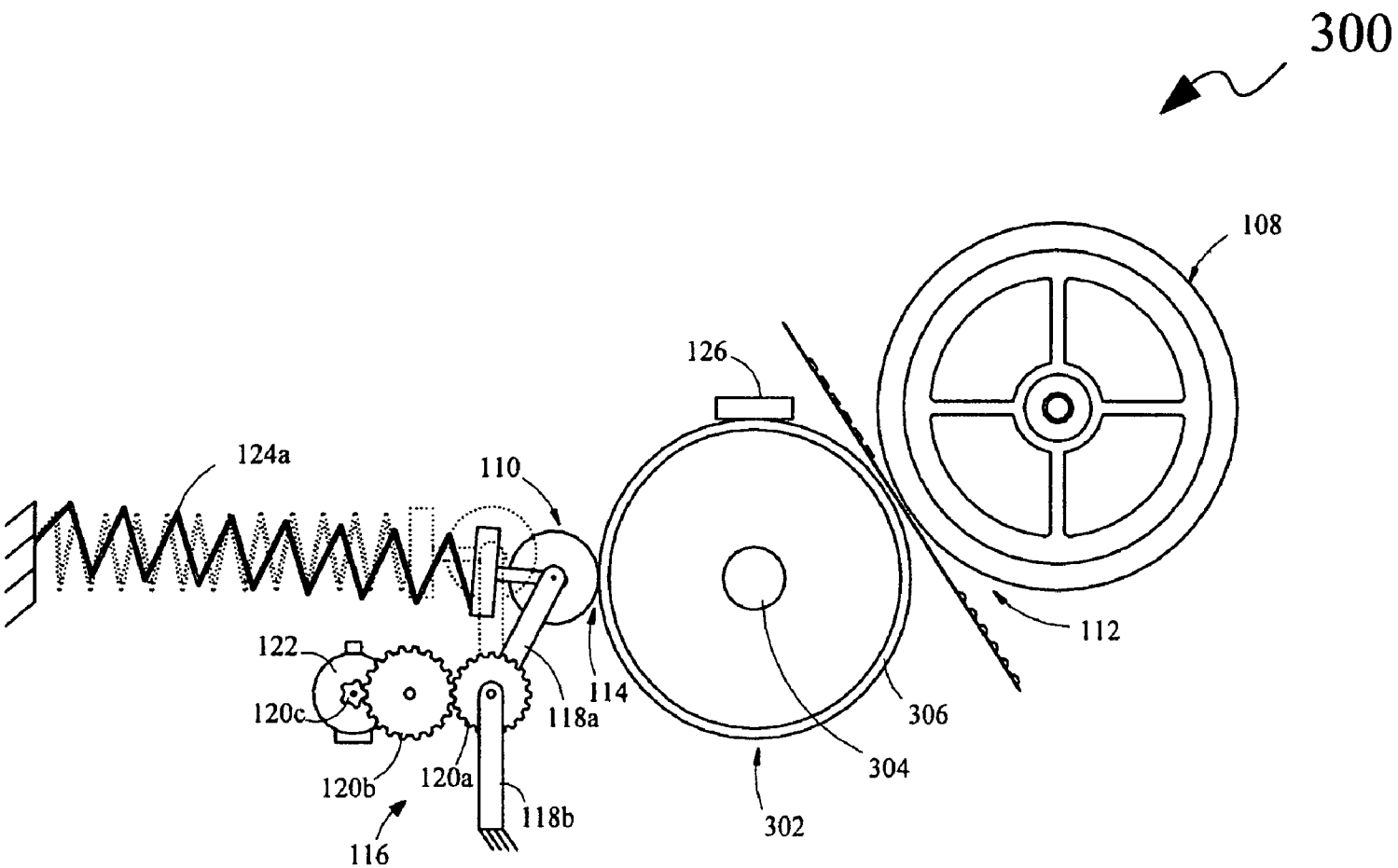
FIG. 3 is a schematic depiction of an image fixing assembly of an image forming apparatus, according to another exemplary embodiment of the present disclosure.

Referring now to FIG. 3, a schematic depiction of an image fixing assembly 300 of an image forming apparatus (not shown) is depicted, according to another exemplary embodiment of the present disclosure. As shown in FIG. 3, image fixing assembly 300 includes a heating unit 302 having a heating element 304 and a fusing member 306; a backup member, such as backup member 108, abuttingly coupled to fusing member 306; and a heat conducting member, such as heat conducting member 110, capable of being retractably coupled to fusing member 306. Specifically, as shown in FIG. 3, heat conducting member 110 is configured to assume a position shown with solid lines for depicting the coupling of heat conducting member 110 with fusing member 306, and a position shown with dotted lines for depicting the decoupling of heat conducting member 110 from fusing member 306.

As described, image fixing assembly 300 is the "hot roll fuser system." Accordingly, in image fixing assembly 300, heating element 304 is a lamp and fusing member 306 is a fuser roll. Fusing member 306 encloses heating element 304, and is capable of being heated by heating element 304. Specifically, heating element 304 is placed centrally within fusing member 306 for uniformly heating fusing member 306. Further, fusing member 306 is configured to rotate around heating element 304. It will be evident to those skilled in the art that either fusing member 306 may be rotated by backup member 108 or backup member 108 may be rotated by fusing member 306.

As explained herein above, backup member 108 is abuttingly coupled to fusing member 306. More specifically, backup member 108 is abuttingly coupled to fusing member 306 for configuring a nip portion, such as nip portion 112, therebetween. Nip portion 112 of image fixing assembly 300 is described in conjunction with FIGS. 1 and 2; accordingly, description thereof is avoided for the sake of brevity.

Further, when a narrow media sheet, such as media sheet 200, passes through nip portion 112, a thermal gradient is generated on at least one of fusing member 306 and backup member 108. Specifically, when media sheet 200 passes through nip portion 112, media sheet 200 does not extend across the full width of fusing member 306 and backup member 108. Therefore, a portion (not numbered) of each of fusing member 306 and backup member 108 is covered by media sheet 200 and a portion (not numbered) of each of fusing member 306 and backup member 108 remains uncovered. Accordingly, portions of fusing member 306 and backup member 108 that are not covered by media sheet 200 tend to retain more heat as opposed to portions of fusing member 306 and backup member 108 that are covered by media sheet 200. As a result, a thermal gradient is generated on the at least one of fusing member 306 and backup member 108.

The thermal gradient generated on the at least one of fusing member 306 and backup member 108 is reduced by heat conducting member 110. As explained herein, heat conducting member 110 is retractably coupled to fusing member 306. Accordingly, when heat conducting member 110 is coupled to fusing member 306, a thermal conduction path, such as thermal conduction path 114, is configured therebetween for enabling flow of heat between fusing member 306 and heat conducting member 110, in order to reduce the thermal gradient generated on the at least one of fusing member 306 and backup member 108.

The retractable coupling of heat conducting member 110 with fusing member 306 is enabled by a retracting mechanism, such as retracting mechanism 116. Retracting mechanism 116 is described in conjunction with FIGS. 1 and 2, accordingly, retracting mechanism 116 includes connecting members, such as connecting members 118*a* and 118*b*; a gear assembly having a plurality of gears, such as gears 120*a*, 120*b*, and 120*c*; a motor 122; and a pair of compression springs, such as compression spring 124*a*. However, retracting mechanism 116 of image fixing assembly 300 enables retractable coupling of heat conducting member 110 to fusing member 306.

In the present embodiment, heat conducting member 110 is adapted to couple to fusing member 306 on generation of the thermal gradient on the at least one of fusing member 306 and backup member 108. More specifically, heat conducting member 110 is adapted to couple to fusing member 306 on detection of the thermal gradient on fusing member 306. For example, in an instance, when several consecutive media sheets, such as media sheet 200, pass through nip portion 112, the thermal gradient is generated on the at least one of fusing member 306 and backup member 108.

The thermal gradient generated on the at least one of fusing member 306 and backup member 108 may be detected by at least one temperature sensing member. For example, image fixing assembly 300 may include a temperature sensing member, such as temperature sensing member 126, operatively coupled to one of fusing member 306 and backup member 108 for detecting the thermal gradient on the at least one of fusing member 306 and backup member 108. In the present embodiment, temperature sensing member 126 is operatively coupled to fusing member 306 for detecting the thermal gradient thereon.

Alternatively, image fixing assembly 300 may be operatively coupled to a counting unit (not shown) capable of counting a predetermined number of narrow media sheets passing through nip portion 112, for the detection of the thermal gradient on the at least one of fusing member 306 and backup member 108. More specifically, the predetermined number of narrow media sheets passing through nip portion 112 may be associated with the generation of the thermal gradient on the at least one of fusing member 306 and backup member 108. For example, when 15 narrow media sheets pass through nip portion 112, a thermal gradient is generated on the at least one of fusing member 306 and backup member 108.

For the purpose of this description, the detection of the thermal gradient on fusing member 306 enables heat conducting member 110 to couple with fusing member 306. Further, as explained herein above, when heat conducting member 110 is retractably coupled to fusing member 306, thermal conduction path 114 is configured therebetween. The configuration of thermal conduction path 114 between fusing member 306 and heat conducting member 110 enables flow of heat between fusing member 306 and heat conducting member 110. More specifically, heat conducting member 110 is composed of a thermally conductive material that enables flow of heat between fusing member 306 and heat conducting member 110. Furthermore, heat conducting member 110 of image fixing assembly 300 is described in conjunction with FIGS. 1 and 2; accordingly, description thereof is avoided for the sake of brevity.

As explained here in conjunction with FIG. 3, heat conducting member 110 is retractably coupled to fusing member 306 for reducing the thermal gradient generated thereon. However, it will be obvious to those skilled in the art that heat conducting member 110 may be retractably coupled to backup member 108 for configuring a thermal conduction path therebetween for enabling flow of heat between backup member 108 and heat conducting member 110, thereby reducing the thermal gradient generated on the at least one of fusing member 306 and backup member 108. It will be evident that the thermal gradient may be reduced in a manner as described in conjunction with FIGS. 1 and 2.

Once the thermal gradient generated on the at least one of fusing member 306 and backup member 108 is reduced by heat conducting member 110, heat conducting member 110 may then be moved away in order to be decoupled from fusing member 306. Specifically, the temperature sensing member detects the reduction in the thermal gradient on the at least one of fusing member 306 and backup member 108. Accordingly, an electrical signal may be sent to electrical circuitry of the image forming apparatus for energizing motor 122. Accordingly, the pivotal movement of heat conducting member 110 away from fusing member 306, as provided by motor 122 through the gear assembly and connecting members 118*a* and 118*c* onto heat conducting member 110, helps in decoupling of heat conducting member 110 from fusing member 306.

More specifically, it will be evident to those skilled in the art that once motor 122 is energized, gear 120*c* is rotated, which in turn rotates gear 120*b*. Furthermore, rotation of gear 120*b* rotates gear 120*a*, which pivotally moves connecting members 118*a* and 118*c* away from fusing member 306 thereby compressing compression springs 124*a* and 124*b* to decouple heat conducting member 110 from fusing member 306. Specifically, compression springs 124*a* and 124*b* are compressed, as shown with dotted lines in FIG. 3, with a backward pivotal movement provided to heat conducting member 110 by connecting members 118*a* and 118*c*, the gear assembly, and motor 122. Accordingly, once motor 122 is energized, heat conducting member 110 is pivotally moved away from fusing member 306 with the help of connecting members 118*a* and 118*c*, the gear assembly, and motor 122, for decoupling of heat conducting member 110 from fusing member 306.

Further, when the narrow media sheets exit from nip portion 112, after fusing of unfused toner images to form fused toner images, the thermal gradient may regenerate on the at least one of fusing member 106 and backup member 108. Accordingly, heat conducting member 110 may again retractably couple to fusing member 306 for the reduction of the regenerated thermal gradient, in order to increase the throughput of the image forming apparatus employing image fixing assembly 300.

As explained herein, the reduction of the thermal gradient from the at least one of fusing member 306 and backup member 108 enables an enhanced throughput of the image forming apparatus. Specifically, the reduction of the thermal gradient from the at least one of fusing member 306 and backup member 108 enables a reduced inter-page gap, which is typically provided between the narrow media sheets, such as media sheet 200, passing through nip portion 112.

Accordingly, it is significant from the above description that heat conducting member 110 of image fixing assembly 300 enables the enhanced throughput of the image forming apparatus, which includes such image fixing assembly 300. More specifically, heat conducting member 110 enables a reduced thermal gradient associated with image fixing assembly 300, thereby providing an easy handling of the narrow media sheets being printed using the image forming apparatus.

In another aspect, the present disclosure provides a method for fixing of images using an image fixing assembly, such as image fixing assembly 100 (explained in conjunction with FIGS. 1 and 2) and image fixing assembly 300 (explained in conjunction with FIG. 3). For the purpose of this description, reference will be made to image fixing assembly 100 of FIGS. 1 and 2. Accordingly, reference will be made to various components of image fixing assembly 100. It should be understood that various components of image fixing assembly 100 have been explained in conjunction with FIGS. 1 and 2; accordingly, a detailed description of image fixing assembly 100 and the components thereof is avoided for the sake of brevity. However, it should be evident that the method described herein below may be performed using image fixing assembly 300 having fusing member 306, backup member 108, and heat conducting member 110, as explained in conjunction with FIG. 3.

Figure 4:
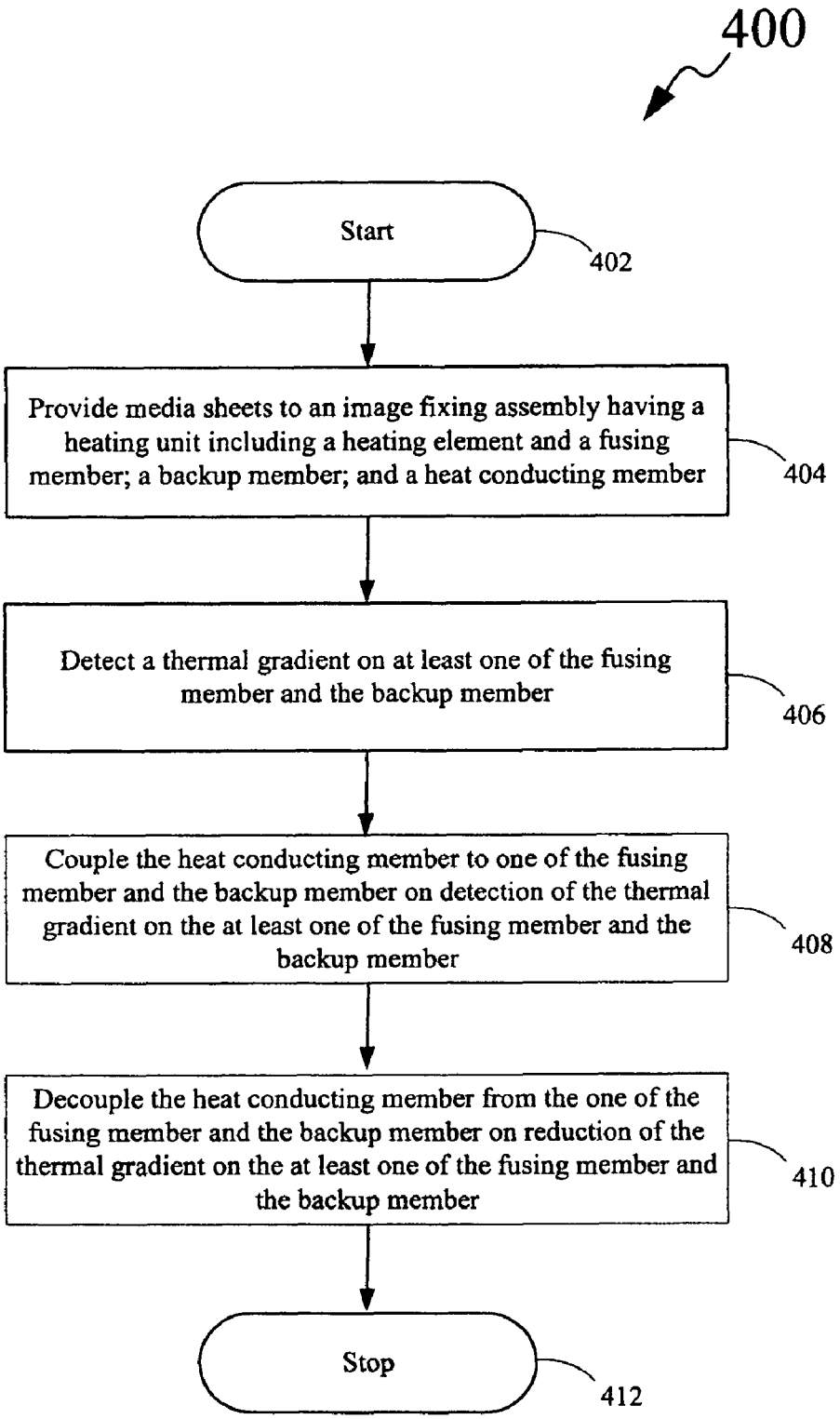
FIG. 4 is a flow chart depicting a method for fixing images on media sheets, according to an exemplary embodiment of the present disclosure.

Referring now to FIG. 4, a flow chart for a method 400 for fixing images on media sheets is depicted, according to an exemplary embodiment of the present disclosure. The media sheets carry unfused toner images that need to be fixed or fused for forming fused toner images. Method 400 for fixing images on the media sheets starts at step 402. At step 404, the media sheets are provided to an image fixing assembly, such as image fixing assembly 100 for fixing images on the media sheets.

As described above, image fixing assembly 100 includes a heating unit, such as heating unit 102 having a heating element, such as heating element 104, and a fusing member, such as fusing member 106. Further, image fixing assembly 100 includes a backup member, such as backup member 108, which is abuttingly coupled to fusing member 106. Furthermore, image fixing assembly 100 includes a heat conducting member, such as heat conducting member 110, capable of being retractably coupled to backup member 108.

Fusing member 106 of image fixing assembly 100 encloses heating element 104. Further, fusing member 106 is configured to rotate around heating element 104 and is capable of being heated by heating element 104. As explained herein, backup member 108 is abuttingly coupled to fusing member 106. More specifically, backup member 108 is abuttingly coupled to fusing member 106 for configuring a nip portion, such as nip portion 112, therebetween. Backup member 108 is further capable of pressing the media sheets including narrow media sheets, such as media sheet 200, against fusing member 106 when media sheet 200 pass through nip portion 112. Suitable examples of a narrow media sheet include, but are not limited to, an envelope, A5 media sheet, a 32 lb executive media sheet, and a 90 lb cardstock media sheet, which may be cut to a narrow width.

Heat conducting member 110 is capable of retractably coupling to backup member 108 for configuring a thermal conduction path, such as thermal conduction path 114, therebetween. As described in conjunction with FIGS. 1 and 2, when heat conducting member 110 contacts with backup member 108, an axial line contact defining thermal conduction path 114 is configured therebetween. Heat conducting member 110 may further be configured to assume one of a solid core configuration and a hollow core configuration.

The retractable coupling of heat conducting member 110 to backup member 108, enables flow of heat between backup member 108 and heat conducting member 110, when a thermal gradient is generated on the at least one of fusing member 106 and backup member 108. The generation of the thermal gradient on the at least one of fusing member 106 and backup member 108 occurs when narrow media sheets pass through nip portion 112. Specifically, the narrow media sheets do not extend across the full width of fusing member 106 and backup member 108. Accordingly, a portion of each of fusing member 106 and backup member 108 is covered by the narrow media sheets and a portion of each of fusing member 106 and backup member 108 remains uncovered. Accordingly, portions of fusing member 106 and backup member 108 that are not covered by the narrow media sheets tend to retain more heat as opposed to portions of fusing member 106 and backup member 108 that are covered by the narrow media sheets. As a result, a non-uniform distribution of heat on the at least one of fusing member 106 and backup member 108 exists, thereby resulting in generation of the thermal gradient on the at least one of fusing member 106 and backup member 108.

At step 406, the thermal gradient on the at least one of fusing member 106 and backup member 108 is detected. In one embodiment of the present disclosure, the thermal gradient generated on the at least one of fusing member 106 and backup member 108 is detected by at least one temperature sensing member, such as temperature sensing member 126, of image fixing assembly 100.

Alternatively, method 400 may include counting of a predetermined number of narrow media sheets passing through nip portion 112, for the detection of the thermal gradient on the at least one of fusing member 106 and backup member 108. Specifically, image fixing assembly 100 of method 400 may be operatively coupled with a counting unit, which is capable of counting the predetermined number of narrow media sheets passing through nip portion 112. Further, the predetermined number of media sheets passing through nip portion 112 may be associated with the generation of the thermal gradient on the at least one of fusing member 106 and backup member 108. For example, when 15 narrow media sheets pass through nip portion 112, a thermal gradient is generated on the at least one of fusing member 106 and backup member 108.

Once the thermal gradient on the at least one of fusing member 106 and backup member 108 is detected, heat conducting member 110 is coupled to backup member 108, at step 408 of method 400. Similarly, with reference to image fixing assembly 300 of FIG. 3, once the thermal gradient is detected on the at least one of fusing member 306 and backup member 108, heat conducting member 110 may be coupled to fusing member 306, at step 408 of method 400.

Referring again to method 400 with reference made to image fixing assembly 100, the coupling of heat conducting member 110 with backup member 108 enables flow of heat between heat conducting member 110 and the one of fusing member 106 and backup member 108 in order to reduce the thermal gradient generated on the at least one of fusing member 106 and backup member 108. For example, as explained herein in conjunction with FIGS. 1 and 2, heat conducting member 110 is retractably coupled to backup member 108, for configuring thermal conduction path 112 therebetween for enabling flow of heat between backup member 108 and heat conducting member 110, thereby reducing the thermal gradient generated on backup member 108. However, it should be evident that retractable coupling of heat conducting member 110 to backup member 108 also enables reduction of the thermal gradient generated on fusing member 106.

Further, as described in conjunction with FIGS. 1 and 2, heat conducting member 110 is composed of a thermally conductive material, which is capable of exchanging heat with the at least one of fusing member 106 and backup member 108. For example, heat conducting member 110 may be composed of a thermally conductive material selected from the group consisting of aluminum, copper, steel, and combinations thereof. Accordingly, when heat conducting member 110 is coupled to backup member 108, the thermally conductive material of heat conducting member 110 enables exchange of heat between heat conducting member 110 and the at least one of fusing member 106 and backup member 108, thereby reducing the thermal gradient.

In an instance where narrow media sheets are printed continuously, heat conducting member 110 may be adapted to retractably couple to backup member 108 in order to reduce the thermal gradient for allowing a higher throughput while printing the narrow media sheets. However, after passage of a stream of narrow media sheets or prior to passage of one or more full width media sheets through nip portion 112, the reduced thermal gradient may still be unacceptable due to print quality problems. Although the thermal gradient is reduced to avoid overheating of image fixing assembly 100 and components thereof, the thermal gradient may need to be further reduced in order to achieve uniform heating across the full width of fusing member 106. Accordingly, a delay after the passage of the stream of narrow media sheets or prior to the passage of the one or more full width media sheets through nip portion 112 may be required, to allow the thermal gradient to be further reduced prior to resuming printing. Specifically, the delay may occur while heat conducting member 110 is still retractably coupled to backup member 108, for enabling heat conducting member 110 to continuously reduce the thermal gradient. Such a delay may be introduced with the help of a motor that continues to rotate fusing member 106 while preventing or reducing the supply of power to heating element 104, until the thermal gradient is reduced to a point where print quality is acceptable across the full width of fusing member 106. Further, such delay is lower than the delay which occurs in the absence of heat conducting member 110.

Once heat conducting member 110 reduces the thermal gradient on the at least one of fusing member 106 and backup member 108, heat conducting member 110 is decoupled from backup member 108, at step 410. More specifically, image fixing assembly 100 of method 400 includes a retracting mechanism, such as retracting mechanism 116, which is capable of retractably coupling and decoupling heat conducting member 110 with backup member 108. For example, retracting mechanism 116 as explained in conjunction with FIGS. 1 and 2 is capable of retractably coupling and decoupling heat conducting member 110 with backup member 108.

The reduction of the thermal gradient generated on the at least one of fusing member 106 and backup member 108, enables an enhanced throughput of image fixing assembly 100 that works on the principles of method 400. Specifically, the reduction of the thermal gradient generated on the at least one of fusing member 106 and backup member 108 enables a reduced inter-page gap, which needs to be typically provided between the narrow media sheets while passing through nip portion 112. Method 400 stops at 412, when the thermal gradient generated on the at least one of fusing member 106 and backup member 108 is reduced.

The present disclosure provides an image fixing assembly, such as image fixing assembly 100 and image fixing assembly 300, to be employed in an image forming apparatus. The image fixing assembly includes a heat conducting member, such as the heat conducting member 110, which serves as an effective thermal conductor that helps in reducing the thermal gradient generated within the image fixing assembly. Further, use of the heat conducting member enables a quick recovery of various components of the image fixing assembly from a high thermal gradient for subsequent rounds of printing. Accordingly, use of the heat conducting member in the image fixing assembly helps in preventing overheating of various components of the image fixing assembly while increasing throughput of the image fixing assembly when printing media sheets, and specifically, narrow media sheets.

The foregoing description of several embodiments of the present disclosure has been presented for purposes of illustration. It is not intended to be exhaustive or to limit the present disclosure to the precise forms disclosed, and obviously many modifications and variations are possible in light of the above teaching. It is intended that the scope of the present disclosure be defined by the claims appended hereto.

What is claimed is:

1. An image fixing assembly comprising:

a heating unit comprising, a heating element, and a fusing member enclosing the heating element, the fusing member configured to rotate around the heating element and capable of being heated by the heating element;

a backup member abuttingly coupled to the fusing member for configuring a nip portion therebetween, the backup member capable of pressing media sheets against the fusing member when the media sheets pass through the nip portion; and a heat conducting member capable of retractably coupling to one of the fusing member and the backup member for configuring a thermal conduction path therebetween for enabling flow of heat between the one of the fusing member and the backup member, and the heat conducting member, for reducing a thermal gradient on at least one of the fusing member and the backup member.

2. The image fixing assembly of claim 1 wherein the reduction of the thermal gradient on the at least one of the fusing member and the backup member allows the reduction of an inter-page gap between the media sheets passing through the nip portion.

3. The image fixing assembly of claim 1 wherein the fusing member is a fuser roll.

4. The image fixing assembly of claim 1 wherein the fusing member is a fuser belt.

5. The image fixing assembly of claim 1 wherein the heat conducting member is composed of a thermally conductive material.

6. The image fixing assembly of claim 5 wherein the thermally conductive material is aluminum.

7. The image fixing assembly of claim 5 wherein the thermally conductive material is copper.

8. The image fixing assembly of claim 1 wherein the heat conducting member is a roll.

9. The image fixing assembly of claim 8 wherein the roll is one of a solid core roll and a hollow core roll.

10. The image fixing assembly of claim 1 wherein the heat conducting member is adapted to retractably couple to the one of the fusing member and the backup member on generation of the thermal gradient on the at least one of the fusing member and the backup member when the media sheets pass through the nip portion.

11. The image fixing assembly of claim 1 wherein the heat conducting member is adapted to retractably couple to the one of the fusing member and the backup member on detection of narrow media sheets passing through the nip portion prior to generation of the thermal gradient on the at least one of the fusing member and the backup member.

12. The image fixing assembly of claim 1 wherein the heat conducting member is adapted to retractably couple to the one of the fusing member and the backup member after passage of narrow media sheets through the nip portion, and prior to passage of one or more full width media sheets through the nip portion.

13. The image fixing assembly of claim 1 further comprising at least one temperature sensing member operatively coupled to the one of the fusing member and the backup member for detecting a thermal gradient on the at least one of the fusing member and the backup member.

14. The image fixing assembly of claim 13 wherein the at least one temperature sensing member is a thermistor.

15. A method for fixing images on media sheets, the method comprising:

providing the media sheets to an image fixing assembly, the image fixing assembly comprising, a heating unit comprising, a heating element, and a fusing member enclosing the heating element, the fusing member configured to rotate around the heating element and capable of being heated by the heating element, a backup member abuttingly coupled to the fusing member for configuring a nip portion therebetween, the backup member capable of pressing the media sheets against the fusing member when the media sheets pass through the nip portion, and a heat conducting member capable of retractably coupling to one of the fusing member and the backup member for configuring a thermal conduction path therebetween for enabling flow of heat between the one of the fusing member and the backup member, and the heat conducting member;

detecting a thermal gradient on at least one of the fusing member and the backup member when the media sheets pass through the nip portion;

coupling the heat conducting member to the one of the fusing member and the backup member on detection of the thermal gradient on the at least one of the fusing member and the backup member, wherein the coupling of the heat conducting member with the one of the fusing member and the backup member enables flow of heat between the heat conducting member, and the one of the fusing member and the backup member, for reducing the thermal gradient on the at least one of the fusing member and the backup member; and decoupling the heat conducting member from the one of the fusing member and the backup member on reduction of the thermal gradient on the at least one of the fusing member and the backup member.

16. The method of claim 15 further comprising counting a predetermined number of narrow media sheets passing through the nip portion prior to the coupling of the heat conducting member to the one of the fusing member and the backup member.

17. The method of claim 15 wherein the fusing member is a fuser roll.

18. The method of claim 15 wherein the fusing member is a fuser belt.

19. The method of claim 15 wherein the heat conducting member is a roll.

20. The method of claim 15 wherein the image fixing assembly further comprises at least one temperature sensing member operatively coupled to the one of the fusing member and the backup member for detecting a thermal gradient on the at least one of the fusing member and the backup member.

* * * * *